US007520595B2

(12) United States Patent
Lu et al.

(10) Patent No.: US 7,520,595 B2
(45) Date of Patent: Apr. 21, 2009

(54) DROPLET EJECTING HEAD

(75) Inventors: Chun-Fu Lu, Hsinchu (TW); Hung-Liang Chiang, Chiayi County (TW); Jinn-Cherng Yang, Yilan County (TW); Chun-Jung Chen, Yunlin Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 204 days.

(21) Appl. No.: 11/309,056

(22) Filed: Jun. 14, 2006

(65) Prior Publication Data

US 2007/0120898 A1 May 31, 2007

(30) Foreign Application Priority Data

Nov. 29, 2005 (TW) ..... 94141853 A

(51) Int. Cl.
*B41J 2/045* (2006.01)

(52) U.S. Cl. ..... 347/69; 347/71

(58) Field of Classification Search ..... 347/71; 400/124.16

See application file for complete search history.

(56) References Cited

U.S. PATENT DOCUMENTS 4,358,781 A * 11/1982 Yamamori et al. ..... 347/21
5,434,606 A * 7/1995 Hindagolla et al. ..... 347/45
6,247,525 B1 6/2001 Smith et al. ..... 165/104.25
6,378,780 B1 4/2002 Martens, III et al. ..... 239/102.2
6,474,566 B1 * 11/2002 Hirota et al. ..... 239/102.2
6,536,682 B1 3/2003 Schnupp et al. ..... 239/102.2
6,550,691 B2 4/2003 Pence ..... 239/102.2
6,629,646 B1 10/2003 Ivri ..... 239/4
6,805,301 B2 10/2004 Garcia ..... 239/102.2
6,854,662 B2 2/2005 Chen ..... 239/102.2

FOREIGN PATENT DOCUMENTS

CN 1445090 10/2003

* cited by examiner

*Primary Examiner*—Luu Matthew
*Assistant Examiner*—Lisa M Solomon
(74) *Attorney, Agent, or Firm*—Jianq Chyun IP Office

(57) ABSTRACT

A droplet ejecting head includes a first substrate, a nozzle plate, a second substrate, an annular symmetrically channel plate and an actuator device. The nozzle plate with a nozzle is disposed on a first surface of the first substrate. The second substrate with a liquid inlet is disposed over the first substrate. The annular symmetrically channel plate with a fluid channel is disposed between the first substrate and the second substrate so that a pressure chamber is formed between the second substrate and the annular symmetrically channel plate. The liquid to be ejected flows to the fluid channel from the liquid inlet and overflows to the pressure chamber from the fluid channel. The actuator device is disposed on the second substrate. The second substrate is deformed by the actuator device for changing volume of the pressure chamber, and then the liquid in the pressure chamber is ejected via the nozzle.

13 Claims, 8 Drawing Sheets

DROPLET EJECTING HEAD

CROSS-REFERENCE TO RELATED APPLICATION

This application claims the priority benefit of Taiwan application serial no. 94141853, filed on Nov. 29, 2005. All disclosure of the Taiwan application is incorporated herein by reference.

BACKGROUND OF THE INVENTION

1. Field of Invention

The present invention relates to an apparatus for supplying liquid. More particularly, the present invention relates to a droplet ejecting head.

2. Description of Related Art

Compared with the conventional atomizer driven by pressure difference, the atomizer using piezoelectric device as driving device has such advantages as quick response, fine structure, portability, micro-size droplet and easy accuracy control etc., so it has been widely applied in medical use, industrial use, engine combustion system, cooling system, and the fabricating process of liquid crystal display, etc.

The U.S. Pat. No. 6,247,525 discloses an atomizer, characterized in using surface wave to atomize the liquid into a droplet so as to cool a hot body. However, in the atomizer, the vibrational energy is scatteringly propagated to all the liquid in the chamber, so that only the liquid on the level can be atomized; therefore, the driving process may result in superfluous energy waste. And, the atomizer must keep the vibrational surface under the liquid to successfully atomize the liquid into a droplet. In other words, the atomizer has direction limitation in use.

The U.S. Pat. No. 6,629,646 discloses a droplet ejector device, and characterized in directly forming a nozzle on the vibrational surface. However, in the atomizer, the liquid to be ejected may contact the piezoelectric device. If the liquid and the piezoelectric device cause a chemical reaction, the chemical reaction may result in piezoelectric device damage and the liquid pollution.

The U.S. Pat. No. 6,474,566 discloses a drop discharge device comprising multiple stacked structures, and characterized in disposing the different locations of liquid-repelling layers with different liquid-repelling coefficients around the nozzle. However, while the volume of the pressure chamber of the droplet discharge device changes and the droplet is to be ejected, a part of liquid may flow back to the liquid supplier chamber without ejecting. In another aspect, the piezoelectric device of the device is not aligned with the nozzle, so that the energy cannot be effectively transmitted to the liquid so as to eject the droplet from the nozzle. In addition, the fabricating process of the device is complicated, and the assembly precision requirement is high and the error tolerance is low.

The U.S. Pat. No. 6,550,691 discloses a reagent dispenser head, characterized in the piezoelectric device separating from the liquid channel, so that the piezoelectric device damage and liquid pollution can be avoided. However, in the fabricating process of the reagent dispenser head, anisotropic etching and isotropic etching process must be performed to form the liquid inlet and the taper nozzle, respectively. The fabricating process is complicated and time-consuming, and it cannot overcome the problem that part of the liquid may flow back to the liquid supplier chamber from the pressure chamber.

As the piezoelectric atomizer has been widely applied in various industries, how to reduce the fabricating cost and improve the efficiency of the piezoelectric atomizer has become an important subject.

SUMMARY OF THE INVENTION

Accordingly, the present invention is directed to provide a droplet ejecting head to resolve the problems of low efficiency and complicated fabricating process of the conventional atomizer.

In order to achieve the above and other aspects, the present invention provides a droplet ejecting head, including a first substrate, a nozzle plate, a second substrate, an annular symmetrically channel plate and an actuator device. Wherein, the first substrate has a first surface and a second surface. The nozzle plate with at least a nozzle is disposed on the first surface of the first substrate. The second substrate with at least a liquid inlet is disposed over the second surface of the first substrate. The annular symmetrically channel plate is disposed between the first substrate and the second substrate so that a pressure chamber is formed between the second substrate and the annular symmetrically channel plate. In addition, the annular symmetrically channel plate has a fluid channel. The liquid to be ejected flows to the fluid channel from the liquid inlet of the first substrate and overflows to the pressure chamber from the fluid channel. The actuator device is disposed on the second substrate, wherein the actuator device is adapted for driving the second substrate to be deformed.

In one embodiment of the present invention, the actuator device is, for example, disposed on the second substrate over the nozzle plate.

According to one embodiment of the present invention, the annular symmetrically channel plate includes a first sub-channel plate, a second sub-channel plate and a third sub-channel plate. Wherein, the first sub-channel plate has at least a through hole. The second sub-channel plate is disposed on the first sub-channel plate, and the second sub-channel plate has at least a first annular hole and at least a second annular hole. Moreover, the first annular hole is adjacent to the second annular hole, and part of the first annular hole and the second annular hole overlap the through hole of the first sub-channel plate. In addition, the third sub-channel plate is disposed on the second sub-channel plate, and the third sub-channel plate has at least a third annular hole, wherein part of the third annular hole overlaps the first annular hole of the second sub-channel plate.

According to one embodiment of the present invention, the first sub-channel plate, the second sub-channel plate, and the third sub-channel plate are, for example, annular plates.

According to one embodiment of the present invention, the nozzle plate includes a nozzle layer. The nozzle layer has at least a nozzle and at least a trench, wherein the nozzle passes through the nozzle layer, and the trench is disposed in a surface of the nozzle layer and encloses the nozzle, and the trench is separated from the nozzle with a distance. Moreover, the nozzle plate further includes a filler filling the trench, and the wetting angle of the surface of the filler is different from the wetting angle of the surface of the nozzle layer.

According to one embodiment of the present invention, the trench is an annular trench, a continuous trench or an intermittent trench.

According to one embodiment of the present invention, the material of the nozzle layer may be a wettable material, and the material of the filler may be a comparatively anti-wettable material with the wettable material.

According to one embodiment of the present invention, the material of the nozzle layer may be an anti-wettable material, and the material of the filler may be a comparatively wettable material with the anti-wettable material.

According to one embodiment of the present invention, the nozzle of the nozzle plate is tapered.

According to one embodiment of the present invention, the actuator device is, for example, a piezoelectric material.

According to one embodiment of the present invention, the nozzle plate includes, for example, a plurality of nozzles arranged in array.

In the spraying process of the droplet ejecting head according to the present invention, the liquid in the pressure chamber will not flow back to the fluid channel. That is, the droplet ejecting head of the present invention can eject droplets of high outflow. Moreover, the annular symmetrically channel plate of the present invention can comprise three annular sub-channel plates, wherein both the second and the third sub-channel plates have the annular holes, and the annular holes are arranged symmetrically with the axis, so that more assembly error tolerance is allowed.

In order to the make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
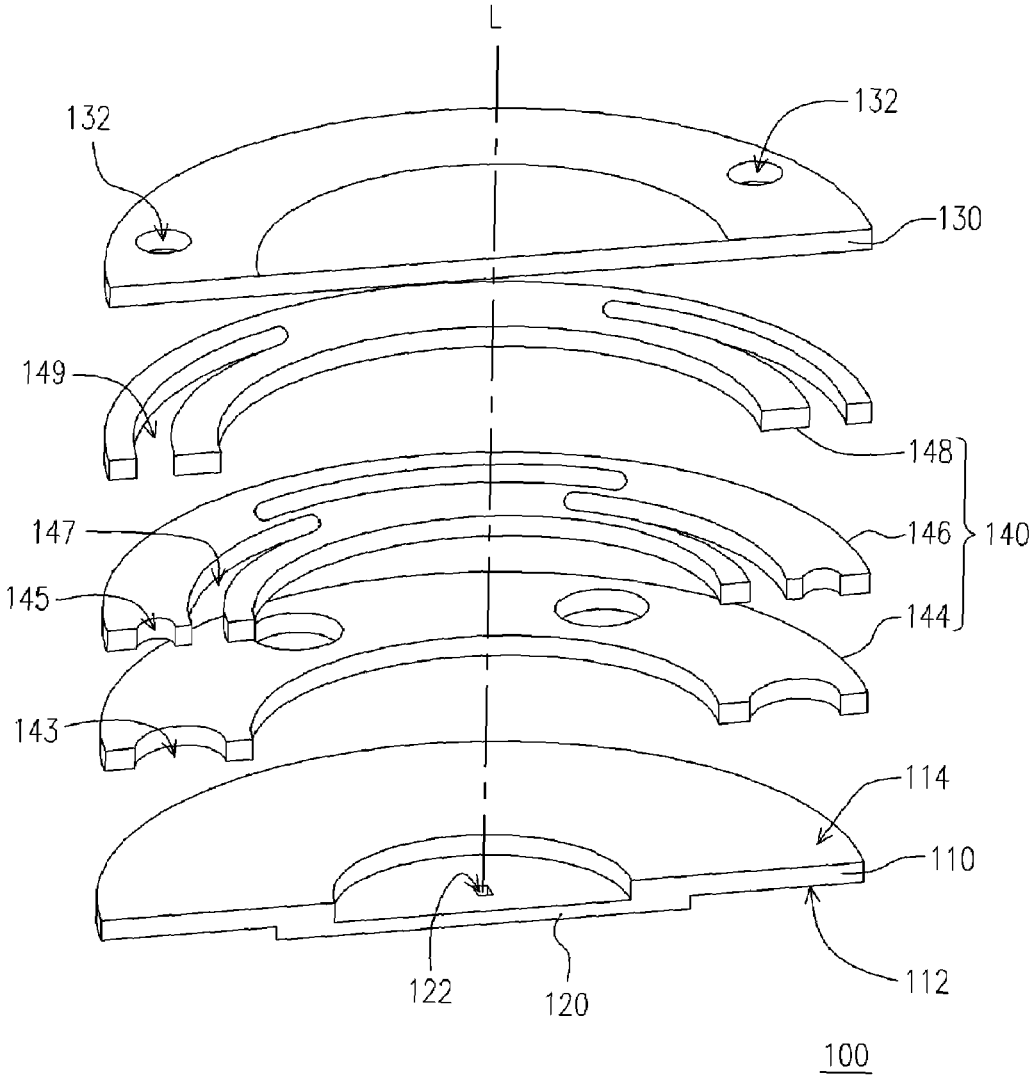
FIG. 1A is a cross-sectional exploded view of a droplet ejecting head according to one embodiment of the present invention.
Figure 1B:
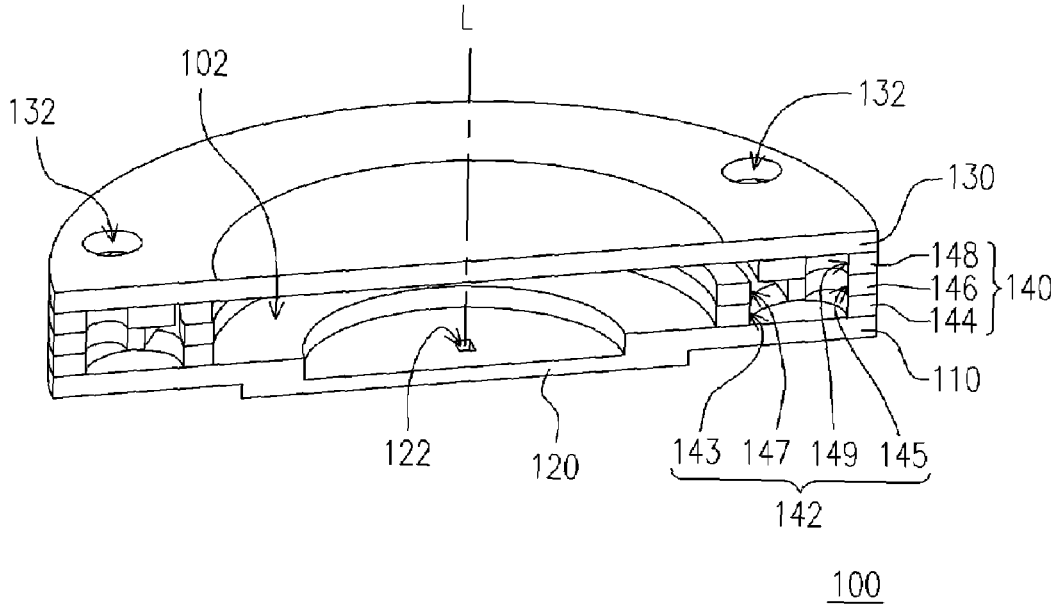
FIG. 1B is a cross-sectional view of a droplet ejecting head according to one embodiment of the present invention.

FIG. 1A is a cross-sectional exploded view of a droplet ejecting head according to one embodiment of the present invention. FIG. 1B is a cross-sectional view of a droplet ejecting head according to one embodiment of the present invention. Referring to FIG. 1A, the droplet ejecting head 100 includes a first substrate 110, a nozzle plate 120, a second substrate 130, an annular symmetrically channel plate 140 and an actuator device 150. Wherein, the nozzle plate 120 with a nozzle 122 is disposed on the first surface 112 of the first substrate 110. The nozzle 122 in the embodiment is, for example, tapered. The second substrate 130 with liquid inlets 132 is disposed over the second surface 114 of the first substrate 110. The liquid (not shown) to be ejected flows to the droplet ejecting head 100 from the liquid inlet 132 of the second substrate 130.

Note that the medicine solution in current medical industry is usually a mixture of multiple medicine liquids. However, the medicine solution may go off shortly after the mixture, so that the medicine liquids are usually mixed shortly before use. In order to improve the convenience, the droplet ejecting head of the present invention may have a plurality of liquid inlets, so that users can inject the medicine liquids to be ejected after being mixed into the droplet ejecting head via the liquid inlets respectively before use. For example, the second substrate 130 of the embodiment has two liquid inlets 132, so that users can respectively inject the two liquids into the droplet ejecting head 100 via the two liquid inlets 132 before use; accordingly, the two liquids can be mixed into mixed solution in the droplet ejecting head 100. The embodiment does not limit the quantity of the liquid inlet 132 of the present invention, and those skilled in the art can determine the quantity according to the actual requirement.

Please refer to FIG. 1A and FIG. 1B. The annular symmetrically channel plate 140 is disposed between the first substrate 110 and the second substrate 130, and a pressure chamber 102 is formed between the annular symmetrically channel plate 140 and the second substrate 130. In particular, the annular symmetrically channel plate 140 in the embodiment comprises, for example, a first sub-channel plate 144, a second sub-channel plate 146, and a third sub-channel plate 148. Wherein, the first sub-channel plate 144, the second sub-channel plate 146, and the third sub-channel plate 148 are, for example, annular plates.

Figure 2A:
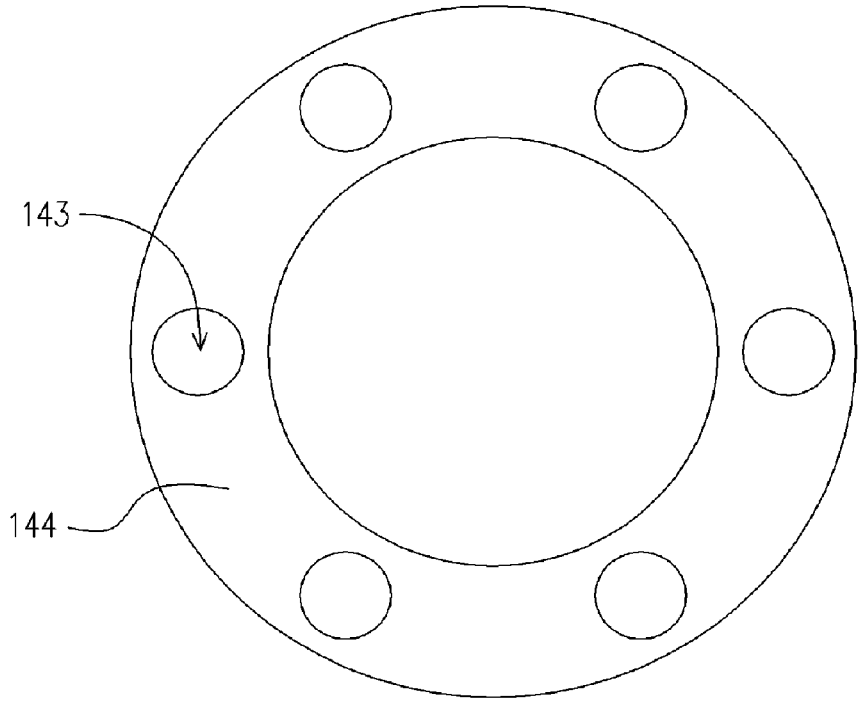
FIG. 2A to FIG. 2C are schematic top views of the first sub-channel plate, the second sub-channel plate and the third sub-channel plate respectively, according to one embodiment of the present invention.
Figure 2B:
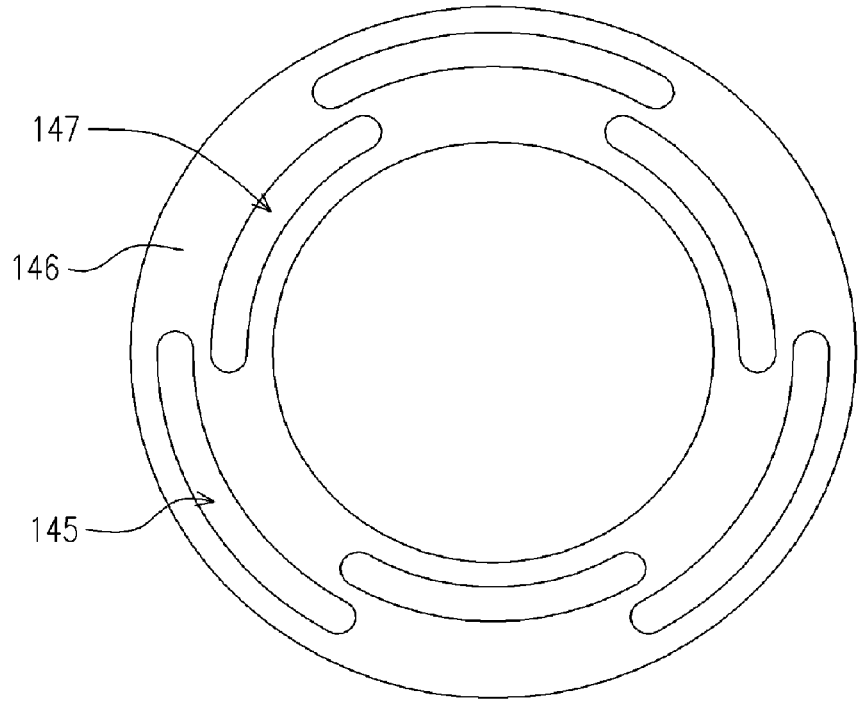
Figure 2C:
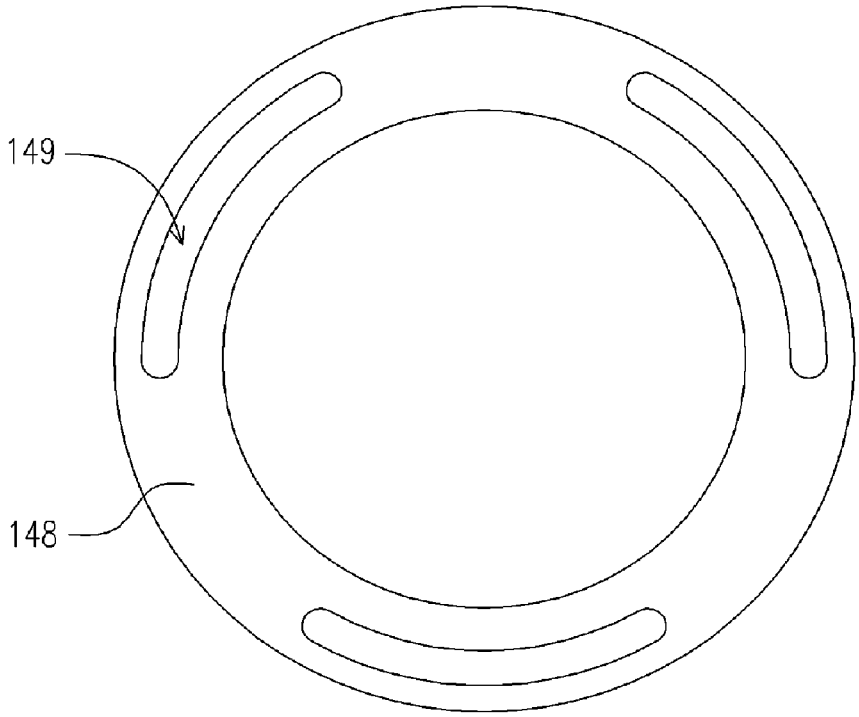

FIG. 2A to FIG. 2C are schematic top views of the first sub-channel plate, the second sub-channel plate and the third sub-channel plate respectively, according to one embodiment of the present invention. Referring to FIG. 2A, the first sub-channel plate 144 of the embodiment has through holes 143. Referring to FIG. 2B, the second sub-channel plate 146 has, for example, three first annular holes 145 and three second annular holes 147. Referring to FIG. 2C, the third sub-channel board 148 of the embodiment has, for example, three third annular holes 149. Of course, the present invention does not limit the quantity of the annular holes, and those skilled in the art can determine the quantity of the annular holes according to the actual requirement.

Please refer to FIG. 1A and FIG. 1B. The second sub-channel plate 146 and the third sub-channel plate 148 are disposed on the first sub-channel plate 144 in sequence. Each first annular hole 145 is disposed symmetrically with a second annular hole 147, and partly overlapped over the through holes 143. Each third annular hole 149 is disposed over the second sub-channel plate 146, and overlaps with part of the two adjacent first annular holes 145 to form a continuous fluid channel.

Figure 3:
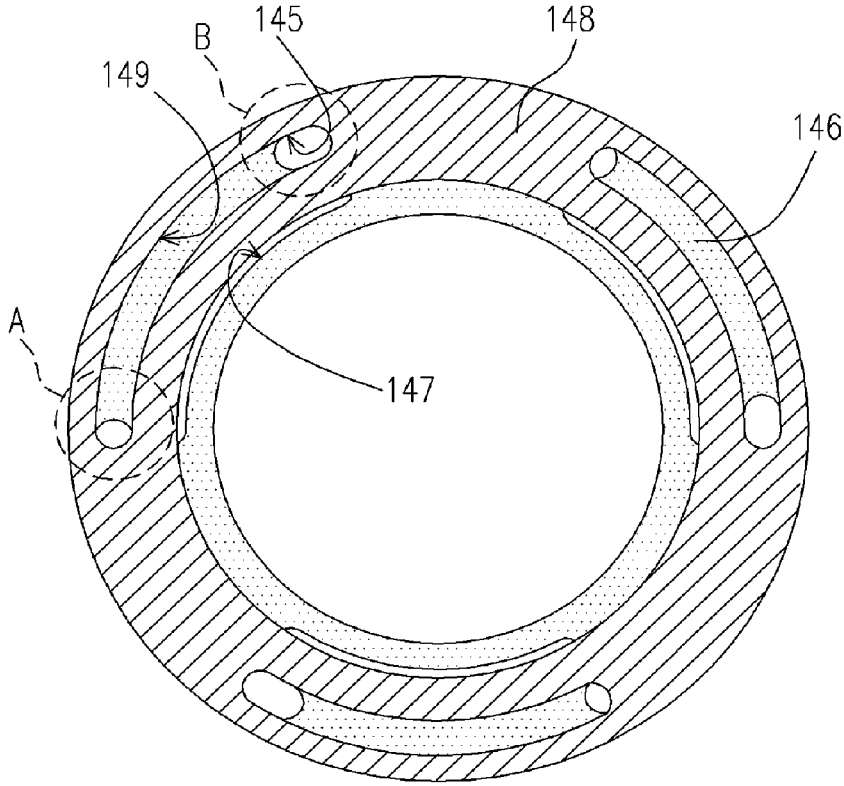
FIG. 3 is a schematic top view of the second sub-channel plate assembling to the sub-channel plate according to one embodiment of the present invention.

Note that, the position of the first annular hole 145 and the position of the third annular hole 149 are symmetrical along the central axis L of the annular symmetrically channel plate 140. Therefore, as shown in FIG. 3, when the third sub-channel plate 148 is mounted on the second sub-channel plate 146, even the overlapping area of the third annular hole 149 and the first annular hole 145 at A is smaller than the predefined value due to the assemble error, the overlapping area of the third annular hole 149 and the first annular hole 145 at B is greater than the predefined value so as to compensate the overlapping area of the first annual hole 145 and the third annular hole 149 at A.

As shown in FIG. 1B, the through hole 143 of the first sub-channel plate 144, the first annular hole 145 and the second annular hole 146 of the second sub-channel plate 146, and the third annular hole 149 of the third sub-channel plate 148 form the fluid channel 142 of the annular symmetrically channel plate 140. In detail, the liquid to be ejected flows to the droplet ejecting head 100 from the liquid inlet 132, and then, flows through the third annular hole 149, the first annular hole 145 and the through hole 143 in sequence, and then overflows to the pressure chamber 102 from the second annular hole 147 from the through hole 143.

In addition, due to space constraint, a liquid inlet (not shown) can also be designed on the first substrate 110 in other embodiments, and the liquid inlet is communicated to the third annular hole 149 through the third sub-channel plate 148.

Figure 4A:
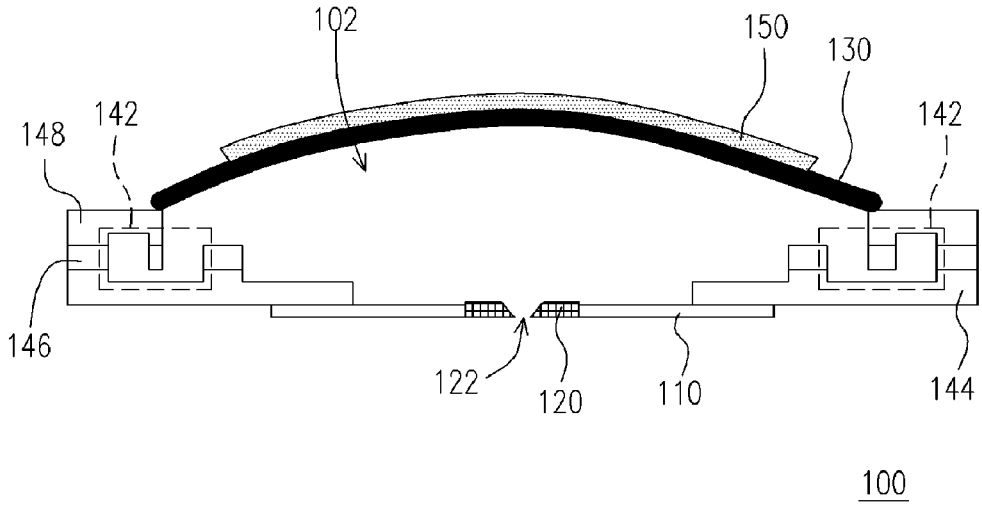
FIG. 4A and FIG. 4B are schematic diagrams of the droplet ejecting head in different status respectively according to the present invention.
Figure 4B:
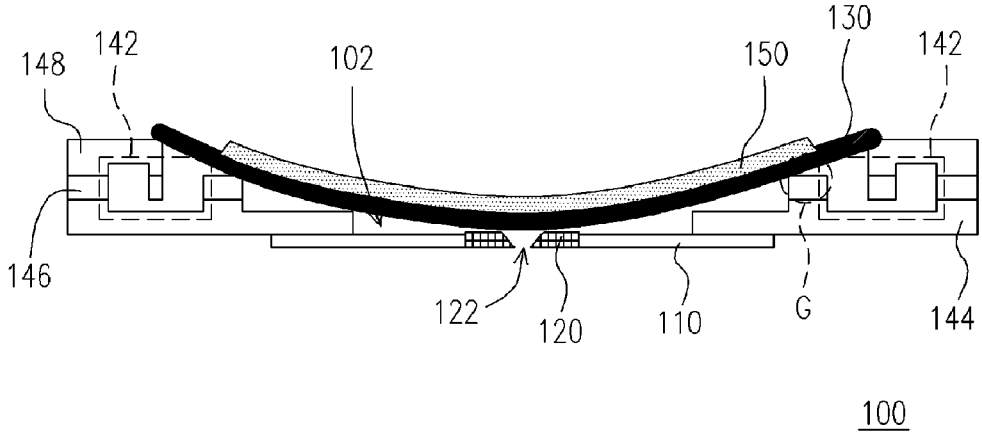

The actuator device 150 is, for example, a piezoelectric device, and disposed on the second substrate 130. The actuator device 150 is, for example, driven by an alternating current signal, causing the actuator device 150 to bend upwards or downwards. When the actuator device 150 is driven by a voltage so as to be bended and deformed, the second substrate 130 will be deformed accordingly. FIG. 4A and FIG. 4B are schematic diagrams of the droplet ejecting head in different status respectively according to the present invention. Referring to FIG. 4A, when the second substrate 130 deforms and bends upwards along with the actuator device 150, the liquid to be ejected flows to the pressure chamber 102 from the fluid channel 142. Next, referring to FIG. 4B, when the second substrate 130 deforms and bends downwards along the actuator device 150, the liquid in the pressure chamber 102 may eject as droplets from the nozzle 122 of the nozzle plate 120 by the pressure. In particular, as the second substrate 130 may be adjacent to the second sub-channel plate 146, the space (marked as G in FIG. 4B) between the second substrate 130 and the second sub-channel plate 146 can be shortened, so that the liquid in the pressure chamber 102 will not flow back to the fluid channel 142. In other words, the droplet ejecting head 100 of the present invention can effectively eject the liquid in the pressure chamber 102.

Moreover, in the embodiment, the actuator device 150 is, for example, disposed over the nozzle 122; therefore, the drop can be ejected effectively by the vibrational energy provided by the actuator device 150.

Figure 5A:
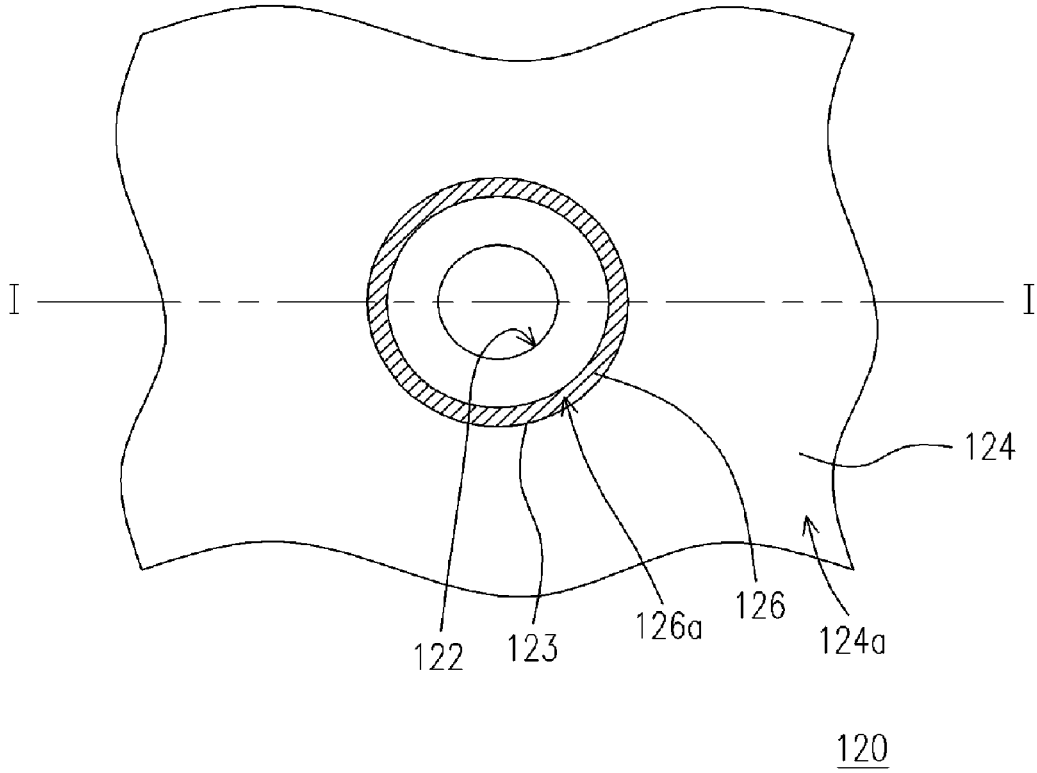
FIG. 5A is a partial platform view of the nozzle plate according to the first embodiment of the present invention.
Figure 5B:
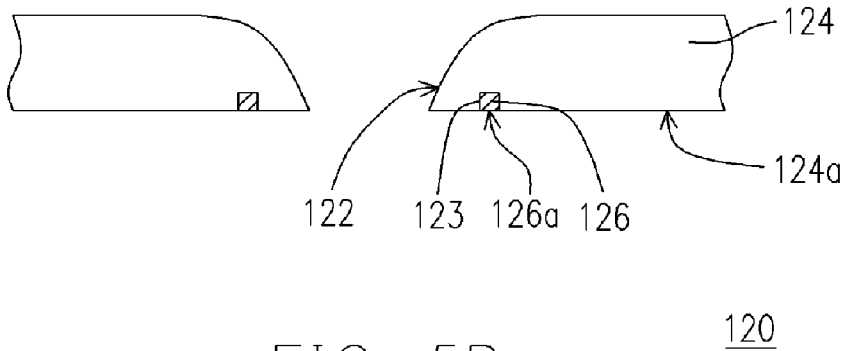
FIG. 5B is a cross-sectional diagram of the nozzle plate in FIG. 5A along line I-I'.

FIG. 5A is a partial platform view of the nozzle plate according to the first embodiment of the present invention, and FIG. 5B is a cross-sectional diagram of the nozzle plate in FIG. 5A along line I-I'. Referring to FIG. 5A and FIG. 5B, the nozzle plate 120 includes a nozzle layer 124. The nozzle layer 124 has a nozzle 122, which passes through the nozzle layer 124, so that the droplet ejecting head 100 (as shown in FIG. 1) using the nozzle plate 120 can eject the droplet via the nozzle 122. In another embodiment, the nozzle layer 124 can also have a plurality of nozzles 122, and the nozzles 122 can be arranged in array (not shown). It can be learned that the present invention does not limit the quantity and arrangement of the nozzles 122.

In order to prevent the liquid that remains on the surface 124*a* adjacent to the nozzle 122 of the nozzle layer 124 from flowing to other area of the surface 124*a* of the nozzle layer 124, the nozzle layer 124 further has a trench 123, disposed in the surface 124*a* of the nozzle layer 124 and encloses the nozzle 122, and the trench 123 is separated from the nozzle 122 with a distance, so that the ink or liquid that remains on the surface 124*a* adjacent to the nozzle 122 of the nozzle layer 124 will flow away from the nozzle 122.

Moreover, the nozzle plate 120 further includes a filler 126 filling the trench 123. The wetting angle of the surface 126*a* of the filler 126 is different from the wetting angle of the surface 124*a* of the nozzle layer 124. In the embodiment, if the material of the nozzle layer 124 is a wettable material (such as nickel, silicon, or the material containing saponite bond) and the material of the filler 126 is a comparatively anti-wettable material (such as carbons tetrafluoride) with the above mentioned wettable material, the wetting angle of the surface 126*a* of the filler 126 is greater than the wetting angle of the surface 124*a* of the nozzle layer 124. On the contrary, if the material of the nozzle layer 124 is an anti-wettable material (such as polyimide) and the material of the filler 126 is a comparatively wettable material (such as nickel, or the material containing saponite bond) with the above mentioned anti-wettable material, the wetting angle of the surface 126*a* of the filler 126 is smaller than the wetting angle of the surface 124*a* of the nozzle layer 124.

No matter how the materials are configured, the configured materials will form a drop limiting area of the surface 124*a* surrounding the nozzle 122 of the nozzle layer 124, so that the ink or liquid that remains on the surface 124*a* adjacent to the nozzle 122 of the nozzle layer 124 will not flow to other area of the surface 124*a* of the nozzle layer 124. And further, the drop accumulating on the surface of the droplet ejecting head, which may cause the atomization to stop, can be reduced.

Figure 6:
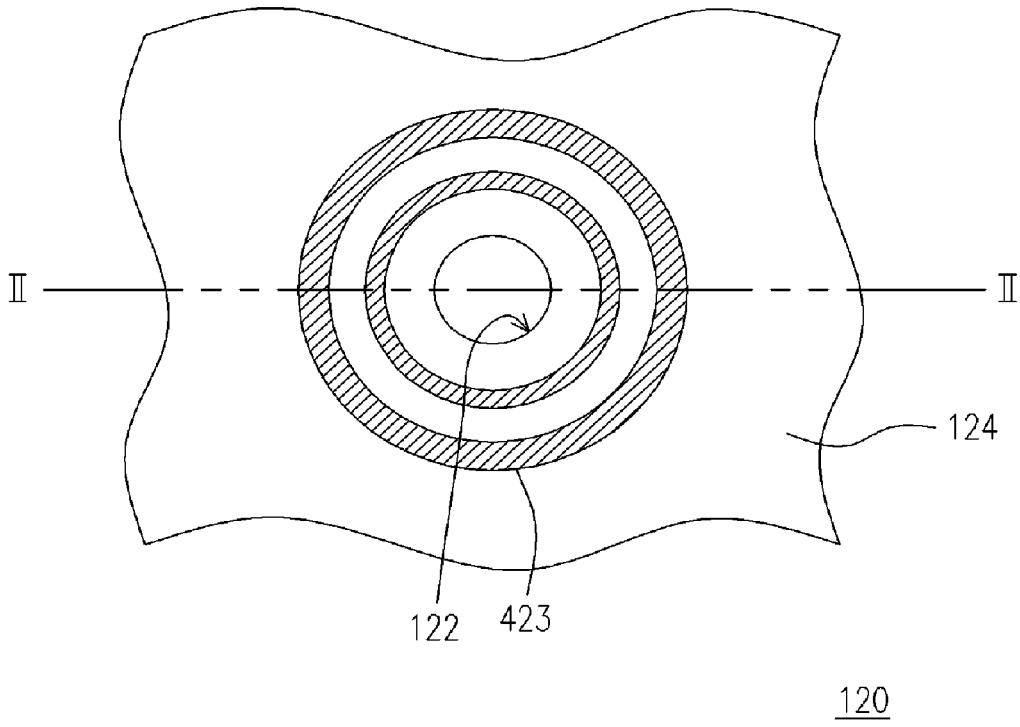
FIG. 6 to FIG. 8 are partial platform diagrams of the nozzle ejecting plates respectively according to other embodiments of the present invention.
Figure 7:
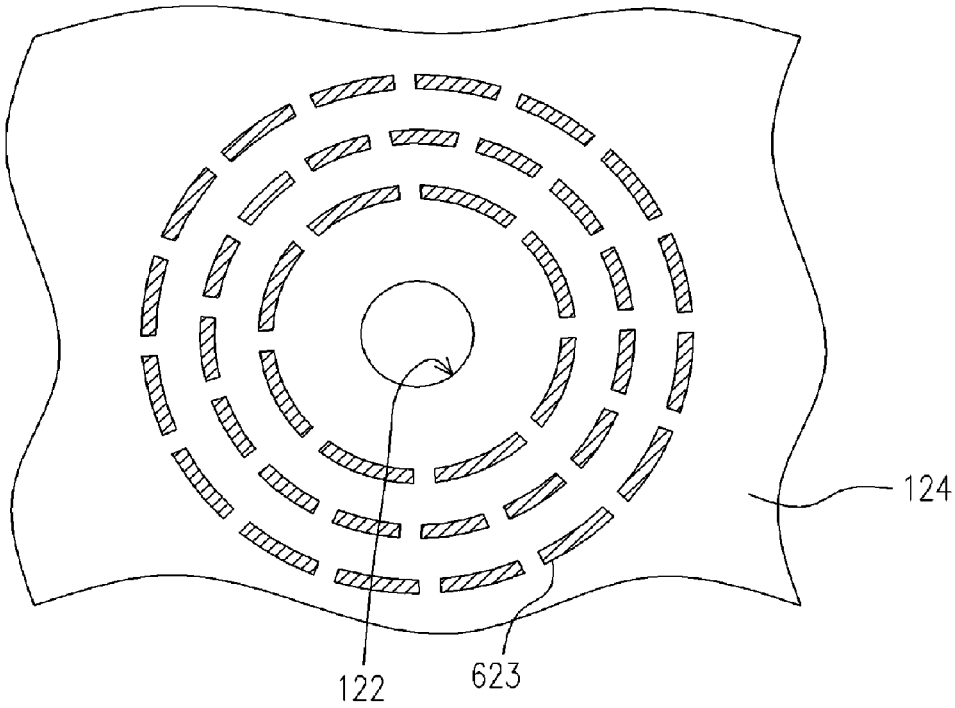
Figure 8:
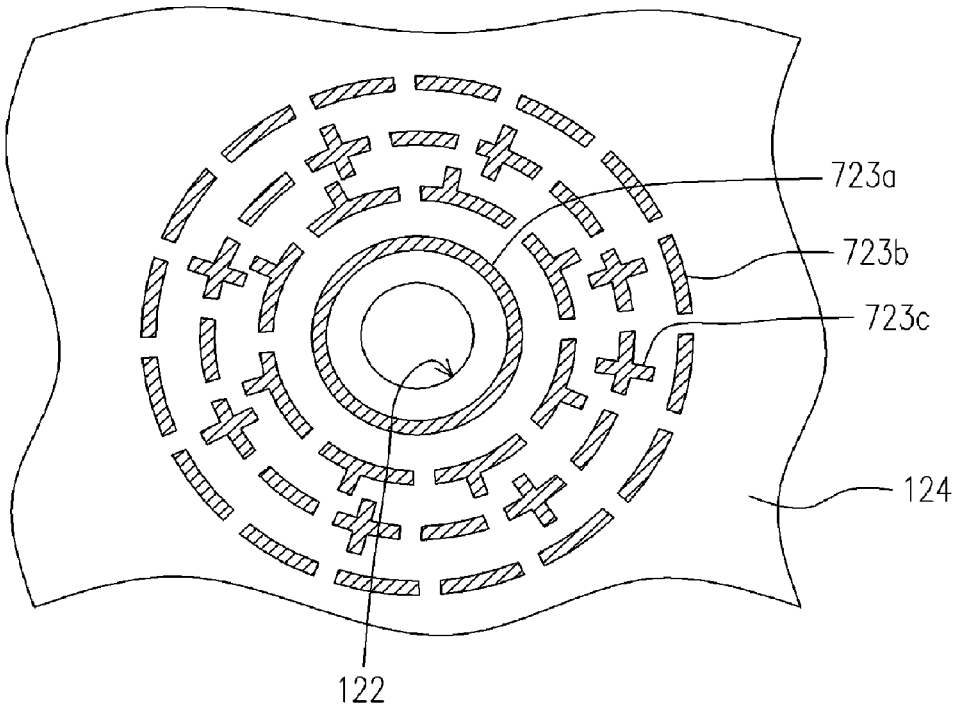

Moreover, although there is only a single annular continuous trench 123 in the nozzle layer 124 of the nozzle plate 120 in FIG. 5A, in other embodiments, the nozzle layer 124 may also have a plurality of trenches. For example, the nozzle layer 124 may have two continuous annular trenches 523, which surround the nozzle 122 in concentric manner, as shown in FIG. 6. In addition, the nozzle layer 124 may also have three intermitted annular trenches 623, which surround the nozzle 122 in concentric manner, as shown in FIG. 7. Or, the nozzle layer 124 may also have a continuous annular trench 723*a* and a plurality of intermitted annular trenches 723*b*, which surround the nozzle 122 in concentric manner, and the nozzle layer 124 may further have a plurality of radial trenches 723*c* which cross the intermitted annular trenches 723*b*, as shown in FIG. 8.

In summary, the present invention has at least the following features:

First, in the droplet ejecting head of the present invention, the liquid to be ejected is in the pressure chamber between the second substrate and the annular symmetrically channel plate, and the actuator device is disposed on the second substrate. That is, the liquid to be ejected is separated from the actuator device by the second substrate disposed between them, and the material of the second substrate is usually an impermeable material which can effectively prevent the actuator device from contacting the liquid to be ejected. It can be learned that the present invention can effectively avoid the problems of liquid pollution and electrode damage resulting from the actuator device contacting the liquid to be ejected.

Second, the actuator device of the present invention can be disposed over the nozzle, so that the vibrational energy provided by the actuator device can be effectively transmitted to the liquid near the nozzle; accordingly, the liquid here is ejected from the nozzle as droplets. In other words, the droplet ejecting head of the present invention has high energy transmission efficiency, so that the required driving power is low.

Third, in the spraying process of the droplet ejecting head of the present invention, the liquid in the pressure chamber will not flow back into the fluid channel. That is, the droplet ejecting head of the present invention can eject droplets in high outflow.

Fourth, the annular symmetrically channel plate of the present invention may comprise three annular sub-channel plates, wherein both the second and the third sub-channel plates have annular holes, and the annular holes are arranged symmetrically along the axis. Therefore, more assembly error is allowed.

Fifth, the nozzle plate of the present invention forms the trench at the surrounding of the nozzle of the nozzle layer, so that the ink or liquid that remains on the surface adjacent to the nozzle of the nozzle layer will flow away from the nozzle. Moreover, the trench may be filled with filler with different wetting angle from the nozzle plate. Therefore, a liquid limit area is formed on the surrounding surface of the nozzle of the nozzle layer, and the liquid limit area can prevent the remaining liquid from accumulating on the surface of the nozzle layer to form accumulated ink on the surface of the nozzle plate, which may cause the atomization to stop.

Sixth, the fabricating process of the droplet ejecting head of the present invention is simple, so that mass-production is feasible.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A droplet ejecting head, suitable for ejecting droplets of a liquid, the droplet ejecting head comprising:

a first substrate, having a first surface and a second surface;

a nozzle plate, disposed on the first surface of the first substrate, and having at least a nozzle;

a second substrate, disposed over the second surface of the first substrate, the second substrate or the first substrate having at least a liquid inlet;

an annular symmetrically channel plate having a fluid channel, disposed between the first substrate and the second substrate, a pressure chamber being formed between the annular symmetrically channel plate and the second substrate, wherein the liquid flows to the fluid channel from the liquid inlet and overflows to the pressure chamber from the fluid channel; and an actuator device, disposed on the second substrate, wherein the actuator device is adapted for driving the second substrate to be deformed.

2. The droplet ejecting head as claimed in claim 1, wherein the actuator device is disposed on the second substrate over the nozzle plate.

3. The droplet ejecting head as claimed in claim 1, wherein the annular symmetrically channel plate comprises:

a first sub-channel plate, having at least a through hole;

a second sub-channel plate, disposed on the first sub-channel plate, and having at least a first annular hole and at least a second annular hole, wherein, part of the first annular hole and the second annular hole overlap the through hole of the first sub-channel plate; and a third sub-channel plate, disposed on the second sub-channel plate, and the third sub-channel plate has at least a third annular hole, wherein part of the third annular hole is overlapped with the first annular hole.

4. The droplet ejecting head as claimed in claim 3, wherein the first sub-channel plate, the second sub-channel plate, and the third sub-channel plate are annular plates.

5. The droplet ejecting head as claimed in claim 1, wherein the nozzle plate comprises a nozzle layer, having the nozzle and a trench, wherein the nozzle passes through the nozzle layer, and the trench is disposed in an outer surface of the nozzle layer and encloses the nozzle, and the trench is separated from the nozzle with a distance.

6. The droplet ejecting head as claimed in claim 5, wherein the nozzle plate further comprises a filler filling in the trench, wherein the wetting angle of the surface of the filler is different from the wetting angle of the surface of the nozzle layer.

7. The droplet ejecting head as claimed in claim 6, wherein the material of the nozzle layer is a wettable material, and the material of the filler is a comparative anti-wettable material with the wettable material.

8. The droplet ejecting head as claimed in claim 6, wherein one of the material of the nozzle layer and the material of the filler is a wettable material, and another one of the material of the nozzle layer and the material of the filler is a comparative anti-wettable material with the wettable material.

9. The droplet ejecting head as claimed in claim 5, wherein the trench is an annular trench.

10. The droplet ejecting head as claimed in claim 1, wherein the nozzle of the nozzle plate is a tapered hole in full portion.

11. The droplet ejecting head as claimed in claim 1, wherein the actuator device is a piezoelectric material.

12. The droplet ejecting head as claimed in claim 1, wherein the nozzle plate has a plurality of nozzles.

13. The droplet ejecting head as claimed in claim 12, wherein the plurality of nozzles are arranged in an array.

* * * * *